US008587488B2

(12) United States Patent
Knudsen et al.

(10) Patent No.: US 8,587,488 B2
(45) Date of Patent: Nov. 19, 2013

(54) MULTIPURPOSE ANTENNA UNIT AND A HEARING AID COMPRISING A MULTIPURPOSE ANTENNA UNIT

(75) Inventors: Ove Knudsen, Smoerum (DK); Poul Henriksen, Smoerum (DK)

(73) Assignee: Oticon A/S, Smoerum (DK)

( * ) Notice: Subject to any disclaimer, the term of this patent is extended or adjusted under 35 U.S.C. 154(b) by 1345 days.

(21) Appl. No.: 12/191,007

(22) Filed: Aug. 13, 2008

(65) Prior Publication Data

US 2009/0046879 A1 Feb. 19, 2009

(30) Foreign Application Priority Data

Aug. 14, 2007 (EP) ..... 07114288

(51) Int. Cl.

| | |
|---|---|
| ***H01Q 21/00*** | (2006.01) |
| ***H01Q 1/00*** | (2006.01) |
| ***H01Q 7/08*** | (2006.01) |
| ***H04R 25/00*** | (2006.01) |

(52) U.S. Cl.

USPC ..... 343/728; 343/729; 343/788; 343/867; 343/879; 381/315; 381/324; 381/331

(58) Field of Classification Search

None

See application file for complete search history.

(56) References Cited

U.S. PATENT DOCUMENTS

| | | | | |
|---|---|---|---|---|
| 4,719,471 | A * | 1/1988 | Killingsworth | 343/792 |
| 4,737,794 | A * | 4/1988 | Jones | 342/448 |
| 4,742,356 | A * | 5/1988 | Kuipers | 342/448 |
| 5,307,072 | A * | 4/1994 | Jones, Jr. | 342/147 |
| 5,578,920 | A * | 11/1996 | Kuster et al. | 324/301 |
| 5,861,852 | A * | 1/1999 | Asakura et al. | 343/702 |
| 6,073,043 | A * | 6/2000 | Schneider | 600/424 |
| 6,078,675 | A * | 6/2000 | Bowen-Nielsen et al. | 381/331 |
| 6,150,986 | A * | 11/2000 | Sandberg et al. | 343/742 |
| 6,398,116 | B1 * | 6/2002 | Kreft | 235/492 |
| 6,424,820 | B1 * | 7/2002 | Burdick et al. | 455/41.1 |

(Continued)

FOREIGN PATENT DOCUMENTS

| | | |
|---|---|---|
| DE | 195 33 105 A1 | 10/1996 |
| EP | 1 376 762 A1 | 1/2004 |

(Continued)

OTHER PUBLICATIONS

IEEE Standard for Safety Levels with Respect to Human Exposure to Radio Frequency Electromagnetic Fields 3 kHz to 300 GHz. IEEE Std C95.1-2005. Apr. 19, 2006.*

(Continued)

*Primary Examiner* — Hoang-Quan Ho

(74) *Attorney, Agent, or Firm* — Buchanan Ingersoll & Rooney PC

(57) ABSTRACT

The invention relates to an antenna unit for wireless communication to a multitude of wireless interfaces comprising a multitude of individual antennas, each antenna comprising a coil comprising at least one winding and the individual antennas embrace the same volume and to a hearing aid comprising such antenna unit. The object of the present invention is to provide an antenna unit and a hearing aid providing several wireless interfaces at a relatively small volume. The problem is solved in that at least one of the coils is adapted for providing an inductive coupling to another device. Among the advantages are reduced space/volume, reduced cost and reduced sensitivity to production tolerances compared to a solution comprising individual, separate antennas. The invention may e.g. be used in wireless communication devices, e.g. mobile telephones, head phones, head sets, hearing aids, etc.

33 Claims, 5 Drawing Sheets

(56) References Cited

U.S. PATENT DOCUMENTS

| | | | | |
|---|---|---|---|---|
| 6,529,169 | B2 * | 3/2003 | Justice | 343/788 |
| 6,538,616 | B1 | 3/2003 | Bedard | |
| 6,563,474 | B2 * | 5/2003 | Nantz et al. | 343/788 |
| 6,693,601 | B2 * | 2/2004 | Billiet et al. | 343/787 |
| 6,924,767 | B2 * | 8/2005 | Kitahara et al. | 343/702 |
| 7,042,411 | B2 * | 5/2006 | Yagi et al. | 343/788 |
| 7,099,486 | B2 * | 8/2006 | Julstrom et al. | 381/331 |
| 7,123,206 | B2 | 10/2006 | Hess et al. | |
| 7,206,426 | B1 * | 4/2007 | Julstrom et al. | 381/331 |
| 7,260,234 | B2 * | 8/2007 | Kasztelan et al. | 381/324 |
| 7,281,314 | B2 * | 10/2007 | Hess et al. | 29/600 |
| 7,307,595 | B2 * | 12/2007 | Schantz et al. | 343/718 |
| 7,541,991 | B2 * | 6/2009 | Qi et al. | 343/702 |
| 7,592,964 | B2 * | 9/2009 | Mullenborn et al. | 343/788 |
| 7,616,166 | B2 * | 11/2009 | Ueda | 343/787 |
| 7,688,991 | B2 * | 3/2010 | Baechler et al. | 381/315 |
| 7,755,552 | B2 * | 7/2010 | Schantz et al. | 343/718 |
| 7,755,558 | B2 * | 7/2010 | Ueda et al. | 343/788 |
| 7,773,943 | B2 * | 8/2010 | Zurek et al. | 455/41.1 |
| 7,796,091 | B2 * | 9/2010 | Ueda | 343/788 |
| 7,843,347 | B2 * | 11/2010 | Nikitin et al. | 340/572.7 |
| 7,940,224 | B2 * | 5/2011 | Kato | 343/722 |
| 7,969,143 | B2 * | 6/2011 | Gilboa | 324/207.17 |
| 8,023,984 | B2 * | 9/2011 | Jin et al. | 455/522 |
| 8,041,066 | B2 * | 10/2011 | Solum | 381/370 |
| 8,134,890 | B2 * | 3/2012 | Rhodes et al. | 367/131 |
| 2002/0193685 | A1 * | 12/2002 | Mate et al. | 600/424 |
| 2003/0050011 | A1 * | 3/2003 | Palermo et al. | 455/41 |
| 2003/0210198 | A1 * | 11/2003 | Nantz et al. | 343/788 |
| 2004/0061660 | A1 * | 4/2004 | Yoshida et al. | 343/788 |
| 2004/0227678 | A1 * | 11/2004 | Sievenpiper | 343/702 |
| 2004/0257072 | A1 * | 12/2004 | Samson | 324/242 |
| 2005/0088357 | A1 * | 4/2005 | Hess et al. | 343/788 |
| 2005/0111681 | A1 | 5/2005 | Essabar | |
| 2005/0285591 | A1 * | 12/2005 | Higgins et al. | 324/207.17 |
| 2006/0244673 | A1 * | 11/2006 | Schantz et al. | 343/788 |
| 2007/0116308 | A1 * | 5/2007 | Zurek et al. | 381/312 |
| 2007/0230727 | A1 * | 10/2007 | Sanguino et al. | 381/315 |
| 2007/0274550 | A1 * | 11/2007 | Baechler et al. | 381/315 |
| 2007/0298846 | A1 * | 12/2007 | Greene et al. | 455/572 |
| 2008/0013763 | A1 * | 1/2008 | Lotter et al. | 381/315 |
| 2008/0095387 | A1 * | 4/2008 | Niederdrank et al. | 381/314 |
| 2008/0159548 | A1 * | 7/2008 | Solum | 381/58 |
| 2008/0186241 | A1 * | 8/2008 | Christensen | 343/718 |
| 2008/0231263 | A1 * | 9/2008 | Rebmann | 324/207.11 |
| 2008/0299930 | A1 * | 12/2008 | Rofougaran et al. | 455/275 |
| 2009/0054749 | A1 * | 2/2009 | He | 600/316 |

FOREIGN PATENT DOCUMENTS

| | | | |
|---|---|---|---|
| GB | 279935 | | 11/1927 |
| WO | WO 98/20626 | A1 | 5/1998 |
| WO | WO 2005/088560 | A1 | 9/2005 |

OTHER PUBLICATIONS

European Search Report dated Jan. 18, 2008.

* cited by examiner

MULTIPURPOSE ANTENNA UNIT AND A HEARING AID COMPRISING A MULTIPURPOSE ANTENNA UNIT

TECHNICAL FIELD

The invention relates to a multipurpose antenna, i.e. a combined antenna having several sets of windings, which are each used individually for addressing different wireless interfaces and to a hearing aid comprising a multipurpose antenna.

The invention may e.g. be useful in applications such as wireless communication devices, e.g. mobile telephones, head phones, head sets, hearing aids, etc.

BACKGROUND ART

Antennas having more than one set of windings are described in the prior at.

GB-279,935 describes an antenna unit for use in wireless telecommunication, the unit comprising two frame windings having different natural wavelengths and arranged so that there is substantially no interaction between the said windings.

U.S. Pat. No. 7,123,206 describes a system comprising multiple antennas wound around a common core, adapted for use in an inductively coupled system for transmitting or receiving electromagnetic signals in three dimensions.

DE 195 33 105 describes an antenna unit for a car comprising three coils, which are perpendicular to each other and adapted for receiving horizontally as well as vertically polarized signals (e.g. TV and radio signals, respectively).

DISCLOSURE OF INVENTION

In space/volume critical applications, where several different antennas are used, there are several challenges:

- cost of several antennas
- volume for several antennas
- spread in mutual influences due to placement accuracy in assembly Examples of such applications are hearing aids, personal communication devices, and other miniature wireless equipment.

For all 3 above reasons, it is desired to combine antennas for multiple (e.g. 2 or more, e.g. 3) wireless interfaces into a single antenna unit by placing several sets of windings, each specific for the individual wireless interface, around a common volume (a former core for forming and/or supporting the antennas is optional).

An object of the present invention is to provide an antenna unit providing several wireless interfaces at a relatively small volume. A further object is to provide a hearing aid with several wireless interfaces.

Objects of the invention are achieved by the invention described in the accompanying claims and as described in the following.

Antenna Unit:

An object of the invention is achieved by an antenna unit for wireless communication to a multitude of wireless interfaces, the antenna unit comprising a multitude of individual antennas, each antenna comprising a coil comprising at least one winding and the individual antennas embrace the same volume and at least one of the coils is adapted for providing an inductive coupling to another device.

Among the advantages are reduced space/volume, reduced cost and reduced sensitivity to production tolerances compared to a solution comprising individual, separate antennas.

The term 'the individual antennas embrace the same volume' is in the present context taken to mean that the individual coils are wound around a common volume (e.g. a former enclosing a specific volume, e.g. a box or ellipsoid). The term is understood to imply that the paths followed by the windings of the individual coils intersect each other in a planar view.

The mutual coupling between antennas of the unit can be controlled by the angle of the windings. The individual coils are preferably arranged in such a way that there is ideally no coupling between windings, e.g. in perpendicular planes.

The combination of several antennas in a single component has the advantage of removing relative placement accuracy requirements between individual antennas, hence the spread in mutual influence is defined by the component alone and is not affected by manual operators or machine processes.

The antenna unit can be pre-tested on a component level and subsequently yield loss can e.g. be minimised in the assembly process.

In an embodiment, at least one of the coils is adapted for communication with another device based on electromagnetic radiation.

In an embodiment, the individual antennas embrace the same volume in that the windings of the individual antennas are wound around the same common volume so that the windings of two arbitrary antennas cross each other when viewed in an appropriate cross-sectional plane.

In an embodiment, the antenna unit comprises 2 or 3 or more individual antennas. In an embodiment, the antenna unit has 2 individual antennas. In an embodiment, the antenna unit has 3 individual antennas. In an embodiment, at least one of the 2 or 3 individual antennas is/are an RF-antenna (not adapted for inductive coupling to the other relatively closely positioned device to which at least one of the antennas is/are adapted to be inductively coupled).

In an embodiment, the mutual coupling between two individual antennas is controlled by the mutual angle of the windings of the two antennas when viewed in an appropriate cross sectional plane.

In an embodiment, the windings of two individual antennas are substantially perpendicular to each other.

In an embodiment, the windings of the individual antennas are wound around a common former.

In an embodiment, the common former comprises a flux amplifying material, e.g. a ceramic material, e.g. a ferrite material.

In a particular embodiment, the at least one coil for inductive coupling is optimized to a predefined frequency range. In a particular embodiment, the antenna unit comprises a tuning circuit for optimizing the frequency range. In a particular embodiment, at least one of the induction coils of the antenna unit is/are adapted to provide a specific preferred frequency range for the inductive communication by adapting at least one of the cross-sectional area, the number of turns, the choice of core material in the coil, the values of a capacitor and/or a resistor of a resonance circuit formed by the coil, the capacitor and/or the resistor.

In a particular embodiment, the transmission frequency for use in the inductive communication is selected to provide that the distance of the transmission (i.e. the distance between the inductively coupled transmitting and receiving coils) and the dimensions of the coils are relatively small compared to the wavelength of transmission frequency. In an embodiment, the physical dimensions of the coils are in the range from 10 to 100 times smaller than the wavelength of transmission frequency, such as between 30 and 70 times smaller.

Inductive transmission can in general be performed in any part of the MF- or HF-bands e.g. in the MHz-range, preferably at frequencies below 100 MHz, such as at frequencies below 30 MHz, e.g. in the range between 300 kHz (or even lower) and 30 MHz, such as in the range between 1 MHz and 20 MHz.

In a particular embodiment, the at least one coil being adapted for providing an inductive coupling to another device is adapted to operate around 4 MHz.

RF-transmission can in general be performed in any part of the RF band, e.g. in the VHF-band. In a particular embodiment, the at least one coil being adapted for communication with another device based on electromagnetic radiation is adapted to operate around 200 MHz.

A preferred method of arranging first and second coils, one optimized for inductive coupling with its main axis in the X direction and the other optimized for RF transmission with its main axis in the Y direction, so that they have virtually no mutual coupling, yields the following characteristics concerning direction of maximum coupling/transmission in case of no polarization loss:

1. The direction of maximum inductive coupling defined as the X direction coincides with the direction of maximum RF transmission.
2. The direction of minimum RF transmission defined as the Y direction coincides with the direction of 6 dB reduced inductive coupling.
3. In the Z direction the RF transmission is at its maximum and the inductive coupling is reduced with 6 dB.

In a further aspect, a mobile telephone comprising an antenna unit as described above, in the detailed description below and in the claims is provided.

In a further aspect, a hearing aid comprising an antenna unit as described above, in the detailed description below and in the claims is provided.

In an embodiment of a hearing aid, the hearing aid and/or the at least one coil being adapted for providing an inductive coupling to another device is adapted to receive signals from the other device (possibly in addition to transmitting signals to the other device).

In an embodiment of a hearing aid, the hearing aid and/or at least one of the at least one coil being adapted for communication with another device based on electromagnetic radiation is adapted to receive signals from the other device (possibly in addition to transmitting signals to the other device).

In an embodiment, the other device is another hearing aid or a communications device, such as a mobile telephone, an audio selection device or the like.

Use of an antenna unit as described above, in the detailed description below and in the claims in a mobile phone or a hearing aid is furthermore provided.

Hearing Aid Comprising an Antenna Unit:

In a further aspect, a hearing aid is furthermore provided. The hearing aid comprises a multitude of wireless interfaces, the hearing aid being adapted to provide that at least one of the wireless interfaces is based on magnetic near field communication, and at least one of the wireless interfaces is based on radiated field communication, the hearing aid comprising an antenna unit comprising a multitude of individual antennas, each antenna comprising a coil comprising at least one winding and the individual antennas being would around the same volume so that the windings of two arbitrary antennas cross each other at an angle when viewed in an appropriate cross-sectional plane, wherein at least one of the coils is coupled to the wireless interface based on magnetic near field communication, and at least one of the coils is coupled to the wireless interface based on radiated field communication. This has the advantage of enabling a compact implementation of at least two wireless interfaces in a hearing aid, in which limited space is a key issue.

In a preferred embodiment, the number of coils is two or three and the angle between the two coils being coupled to the wireless interface based on magnetic near field communication and the wireless interface based on radiated field communication, respectively, is ninety degrees. This has the advantage that the (magnetic) near field communication system and the radiated (electromagnetic far-field) communication system provides a high degree of isolation between them (i.e. low mutual coupling) AND at the same time provide identical main directions for the two systems.

It is intended that the structural features of the antenna unit described above, in the detailed description of 'mode(s) for carrying out the invention' and in the claims can be combined with the hearing aid comprising an antenna unit. Embodiments of the hearing aid have the same advantages as the corresponding antenna unit.

Hearing Aid System:

In a further aspect, a hearing aid system comprising two hearing aids, each as described above, is furthermore provided. Each hearing aid is adapted to communicate with the other hearing aid using the wireless interface based on magnetic near field communication or the wireless interface based on radiated field communication.

In a preferred embodiment, one of the interfaces is used for wireless communication with another device, e.g. a mobile telephone or an audio signal selection device.

Further objects of the invention are achieved by the embodiments defined in the dependent claims and in the detailed description of the invention.

As used herein, the singular forms "a," "an," and "the" are intended to include the plural forms as well, unless expressly stated otherwise. It will be further understood that the terms "includes," "comprises," "including," and/or "comprising," when used in this specification, specify the presence of stated features, integers, steps, operations, elements, and/or components, but do not preclude the presence or addition of one or more other features, integers, steps, operations, elements, components, and/or groups thereof. It will be understood that when an element is referred to as being "connected" or "coupled" to another element, it can be directly connected or coupled to the other element or intervening elements may be present. Furthermore, "connected" or "coupled" as used herein may include wirelessly connected or coupled. As used herein, the term "and/or" includes any and all combinations of one or more of the associated listed items.

BRIEF DESCRIPTION OF DRAWINGS

The invention will be explained more fully below in connection with a preferred embodiment and with reference to the drawings in which.

The figures are schematic and simplified for clarity, and they just show details which are essential to the understanding of the invention, while other details are left out. Throughout, the same reference numerals are used for identical or corresponding parts.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

MODE(S) FOR CARRYING OUT THE INVENTION

An antenna unit according to the invention can e.g. be used in a head-worn audio device, such as a hearing aid, for providing communication to another device (e.g. another hearing aid in a binaural system) e.g. using an inductive coupling. Alternatively, inductive communication between a fist head-worn audio device could be used to an external device for programming the audio device, an audio selection device, wherein an audio signal can be selected among a number of audio signals received by the audio selection device (possibly including a signal from a mobile telephone or from a radio or music player, e.g. a MP3-player or the like). FM-transmission can e.g. be useful between a head-worn audio device and a wireless microphone (e.g. in a classroom amplification or conference system), or a TV, radio, music player, etc. By using an antenna unit according to the invention, several wireless interfaces can be implemented in a device, e.g. a hearing aid, where minimum space (volume) is an important parameter. Further, the tolerances for the relative mutual placement of various coils can be handled in one unit and thus generally relaxed.

In an embodiment, an antenna unit according to the invention is included in a hearing aid. In an embodiment, one of the interfaces of the antenna unit is to a telecoil for receiving a 'broadcast' signal.

FIG. 1 shows embodiments of an antenna unit according to the invention.

Figure 1A:
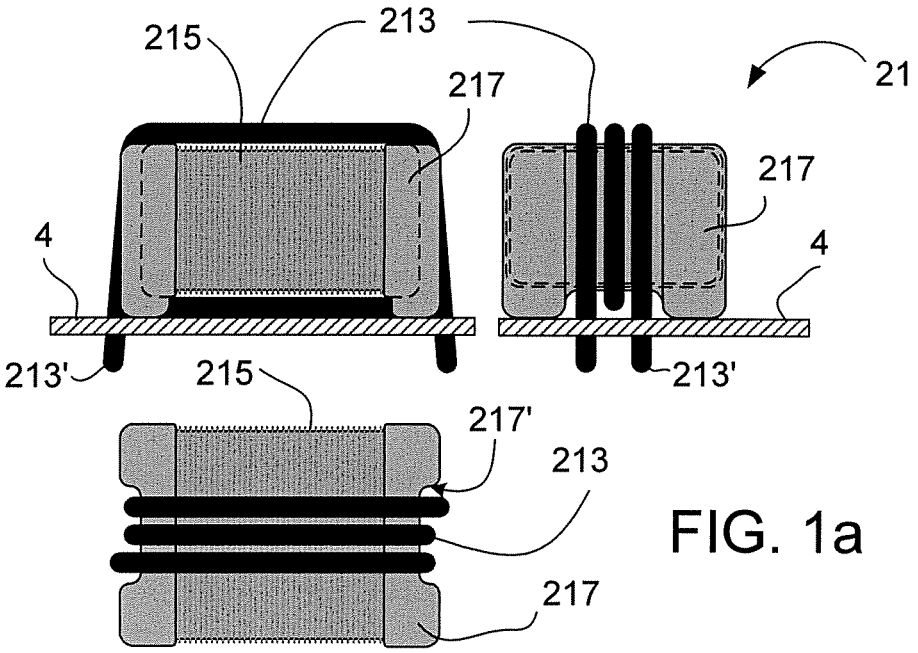
FIG. 1 shows embodiments of an antenna unit according to the invention.
Figure 1B:
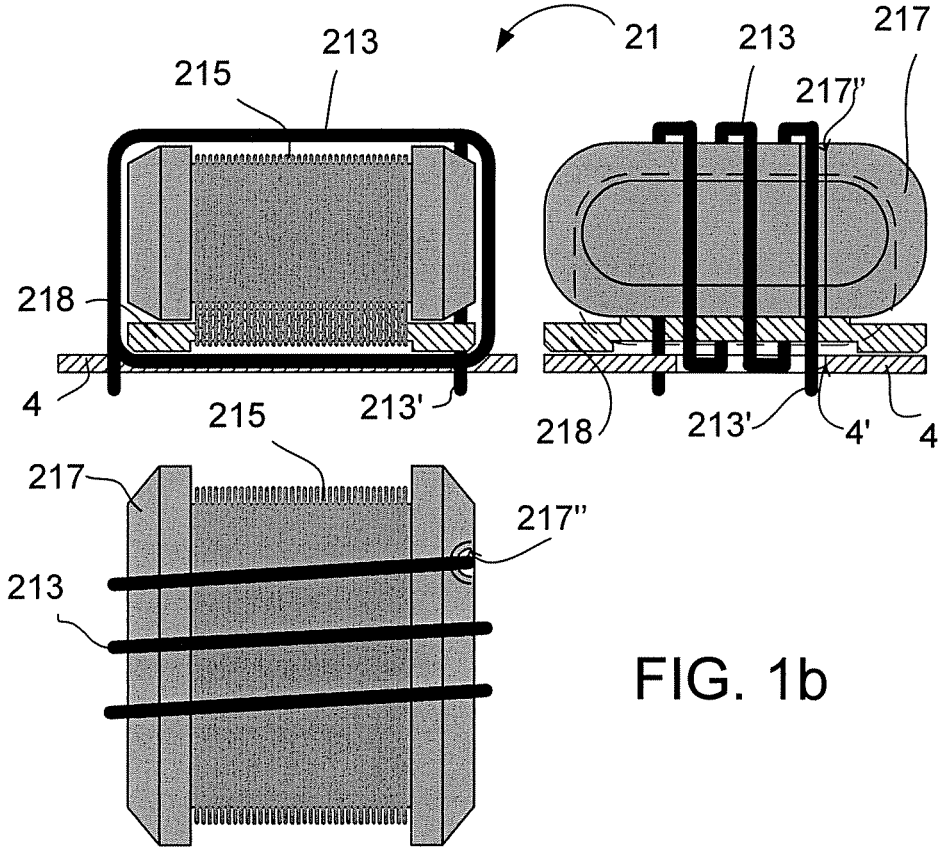

FIGS. 1*a* and 1*b* each illustrate 3 perpendicular cross sections of embodiments of an antenna unit 21 according to the invention comprising two sets of windings 213, 215 placed in perpendicular planes on a common antenna core 217, the antenna core optionally comprising a flux amplifying material, e.g. a magnetically soft material, e.g. comprising iron, e.g. a ceramic core. A ceramic core can be adapted to have good magnetic properties AND to be mechanically stable. In both embodiments, the antenna unit is adapted for being mounted on a substrate 4, e.g. a printed circuit board, e.g. together with other electronic components, e.g. of a hearing aid. The coil windings can be terminated on metal plated legs 213' to enable SMD-like mounting. Preferably, the antenna unit is adapted for surface mounting on a substrate.

The dimension of the antenna unit is e.g. 5 mm×5.5 mm×2.5 mm, but can in general be adapted to the practical application.

One coil 213 has a relatively low inductance, here 160 nH (implemented by 3 turns of a 0.3 mm diameter Cu-wire) and is intended for reception of a ~200 MHz FM signal (i.e. TEM dominant field). The other coil 215, here being wound perpendicularly to the first coil, has a higher inductance, here 19 pH (implemented by 50 turns of a 0.08 mm Cu-wire) and is intended for reception of a ~4 MHz magnetic link (i.e. M dominant field).

In the embodiment shown in FIG. 1*a* both coils 213 and 215 are wound in indentation of the antenna core 217 (cf. e.g. indentation 217' wherein coil 217 is located). Alternatively, the outermost coil 213 can be partially sunk into the substrate 4 to save space. Height of the unit can be reduced by making a slot in the substrate under the antenna for the 2 returning windings of the FM-coil 213 and removing the antenna feets (the parts of the core 217 that rests on the substrate 4 in FIG. 1*a*). That will also simplify the antenna shape. This is illustrated in the embodiment shown in FIG. 1*b*, cf. opening (or indentation) 4' in the substrate 4 (the 'feet' are not present in the embodiment shown in FIG. 1*b*). In the embodiment in FIG. 1*b*, the windings of the coil 215 for magnetic communication are terminated on a metallized interposer 218 to enable SMD mounting (SMD=Surface Mount Device). In the embodiment of FIG. 1*b*, the outermost coil (here FM-coil 213) is not in general wound in an indentation (cf. 217' in FIG. 1*a*) in the antenna core 217 (but an opening 4' in the substrate 4 facing the antenna unit 21 is made instead). Instead a slot 217" is made in a part of the outer face of the antenna core 217 to guide (and protect) an end part of the FM-coil towards it termination on the substrate.

The transmission frequency for use in the inductive communication is selected with a view to the rate of data transmission needed, the transmission distance, the (maximum) size of the coils (e.g. restricted by available space in a hearing aid) noise considerations, signal form factors, etc. to provide that the distance of the transmission (i.e. the distance between the inductively coupled transmitting and receiving coils) and the dimensions of the coils are relatively small compared to the wavelength of transmission frequency.

An alternating magnetic field is generated in a transmitting coil by excitation with an alternating electric signal applied to the transmitting coil. If a 'receiving' coil (e.g. of an antenna unit according to the invention) is placed in the vicinity of the transmitting coil, an alternating current will be induced in the receiving coil. Thereby a signal (possibly modulated on a carrier) can be received in a receiving device (e.g. a hearing aid).

The reception of the signals is continuous (as opposed to interleaved or time multiplexed).

The principle can be extended to a 3rd plane. The core is optional (i.e. can be constituted by an air-volume), but a core can improve the antenna performance by proper choice of the core material (e.g. a magnetic material having $\mu_r>1$) to improve the sensitivity of the receiving coil, which can alternatively be used to decrease its dimensions.

Figure 2A:
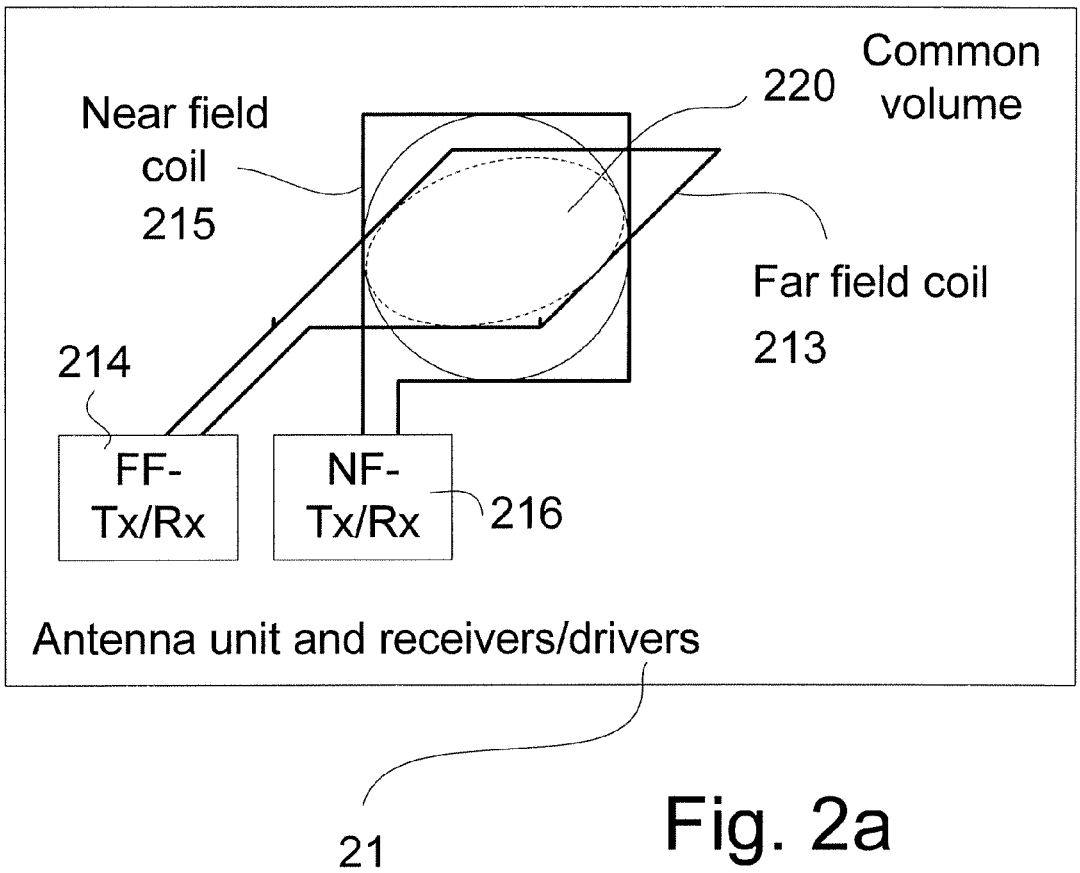
FIG. 2 shows an antenna unit comprising corresponding transmit/receive units according to an embodiment of the invention (FIG. 2*a*) and various embodiments of a hearing aid system according to the invention (FIGS. 2*b*, 2*c*, 2*d*).

FIG. 2*a* schematically shows an antenna unit 21 according to an embodiment of the invention. The antenna unit comprises a near field coil 215 and corresponding (optional) transmit/receive (Tx/Rx) unit 216 and a far field coil 213 and corresponding (optional) Tx/Rx unit 214. The Tx/Rx units 216, 217 may or may not form part of the antenna unit. The Tx/Rx units 216, 217 may represent transmission-only or reception-only or transmission and reception capabilities. The coils share the same common volume as schematically indicated by volume 220 (here illustrated as a sphere). The coils are shown to have only one turn, but may in practice have any number of turns adapted for the practical use.

Figure 2B:
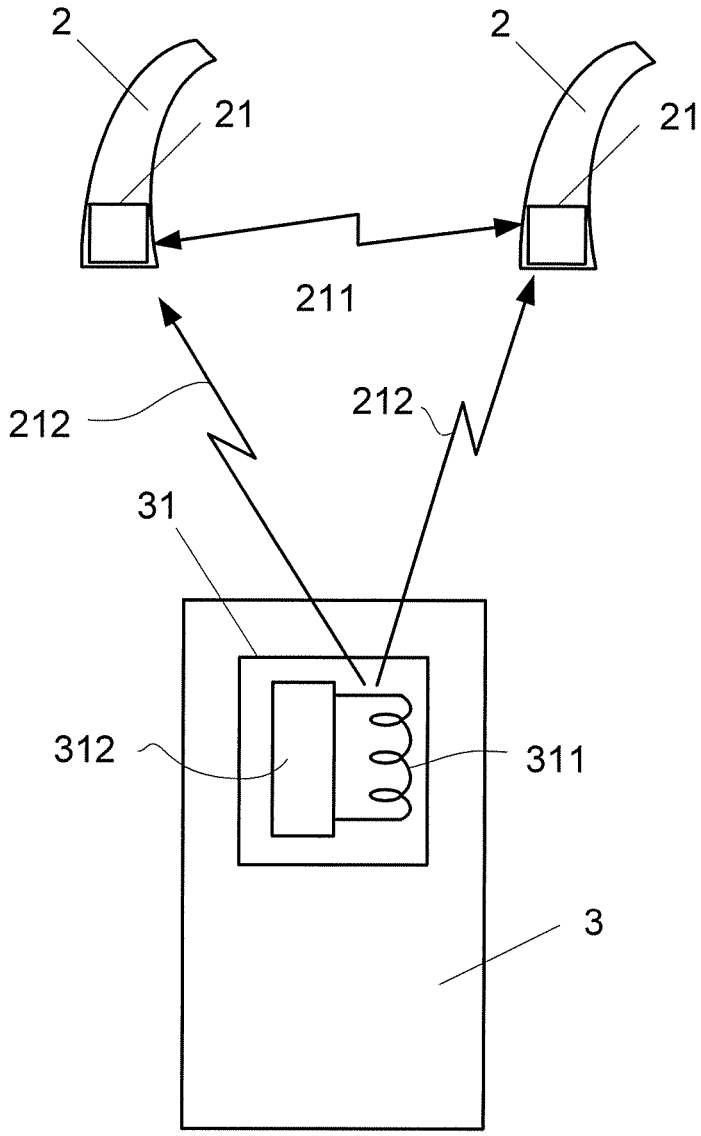
Figure 2C:
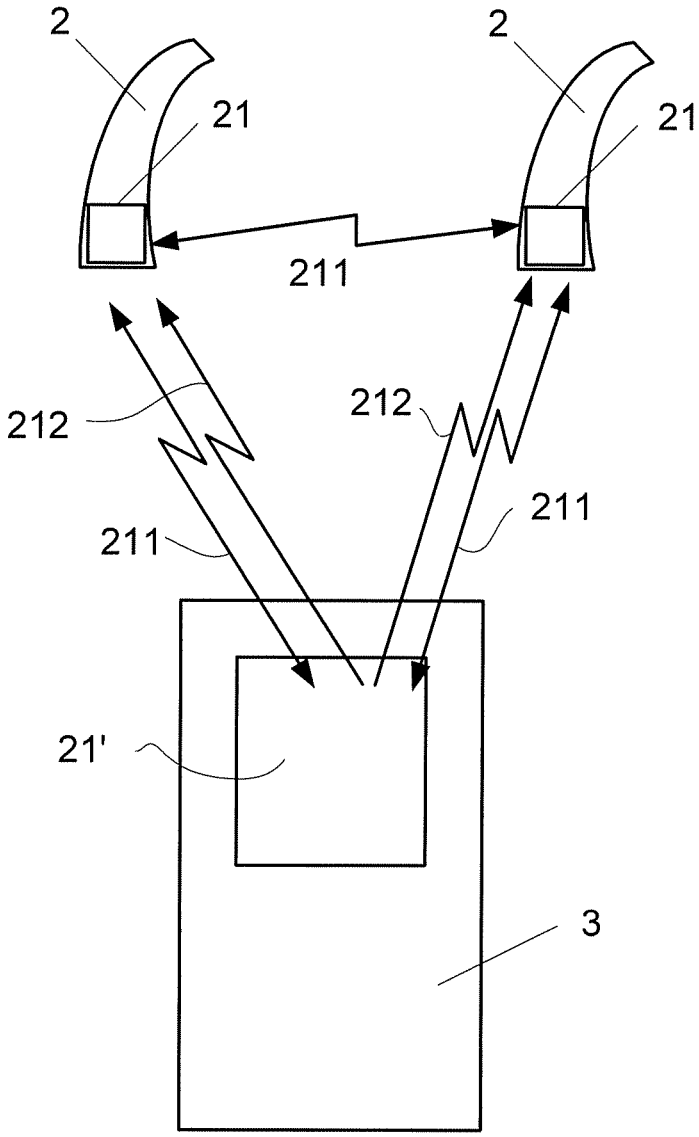
Figure 2D:
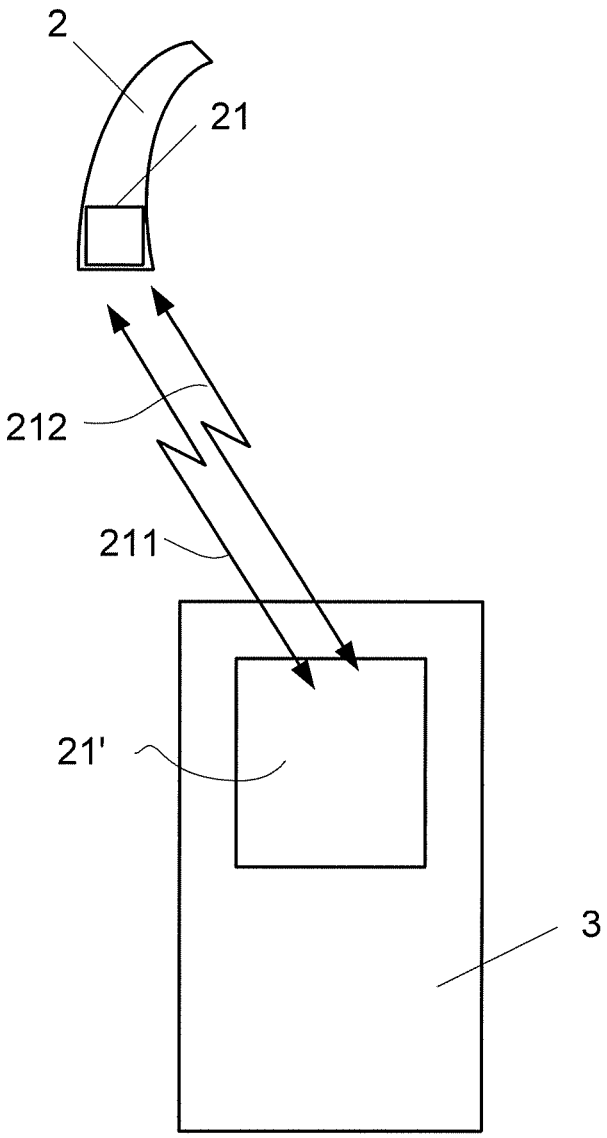

FIGS. 2*b*, 2*c*, 2*d* show various embodiments of a hearing aid system according to the invention, each embodiment comprising one or two hearing aids 2 and a communications device 3 (e.g. a mobile telephone or an entertainment device or an audio selection device for selecting an audio signal among a multitude of audio signals).

FIG. 2*b* shows a hearing aid system comprising two hearing aids 2 and a communications device 3. The communications device comprises a transmission unit 31 (comprising a driver 312 and an antenna coil 311) for establishing a wireless connection 212 to each of the hearing aids 2. Here the wireless link 212 is a one-way link and based on inductive communication. The inductive link 212 is e.g. used for forwarding an audio signal (e.g. a streamed audio signal) to the hearing aid.

Each of the hearing aids 2 comprises an antenna unit 21, and each hearing aid is adapted for receiving a signal from the communications device via the inductively coupled link 212. Additionally, each of the hearing aids is adapted for establishing a wireless connection 211 between them. Here the wireless link 211 is a two-way link and based on radiated fields. The far field link 211 can e.g. be used to exchange status information between the two hearing aids (e.g. concerning directionality of a received signal from the microphone system of the hearing aids).

FIG. 2*c* shows another embodiment of a hearing aid system comprising two hearing aids 2 and a communications device 3. The difference to the embodiment of FIG. 2*b* is that the system is adapted to provide that an additional (here two-way) wireless link 211 (here based on radiated fields) can be established between the communications device 3 and each of the hearing aids 2. The communications device comprises an antenna unit 21', which may (or may not) be an antenna unit as described above having two or more coils sharing the same volume. In any case the antenna unit 21' comprises the appropriate two antennas and corresponding Rx-/Tx-circuitry (in the communications device, the antenna responsible for far-field communication may, but need not, be formed as a coil). In this case, the antenna units 21 of each of the hearing aids comprise three coils (and the hearing aids comprise corresponding appropriate Tx-/Rx-units) to support the two links based on radiated fields and the one link based on inductive coupling.

In the above examples the link 211 between the hearing aids is mentioned to be based on radiated electromagnetic fields (far-field communication). This link may alternatively be based on magnetic field coupling (near-field communication). In that case the system is adapted to provide that the or at least one of the links between the hearing aids and the communications device is based on radiated fields.

FIG. 2*d* shows an embodiment of a hearing aid system comprising one hearing aid 2 and a communications device 3. In this case the system is adapted to provide that a (here two-way) wireless link 211 (here based on radiated fields) and a wireless link 212 (here two-way and based on inductive coupling) can be established between the communications device 3 and the hearing aid 2.

Other system combinations may be envisaged based on the ideas of the present invention, e.g. the hearing aid may be adapted to establish an inductive link with a telecoil and an wireless link based on radiated fields to a communications device.

The invention is defined by the features of the independent claim(s). Preferred embodiments are defined in the dependent claims. Any reference numerals in the claims are intended to be non-limiting for their scope.

Some preferred embodiments have been shown in the foregoing, but it should be stressed that the invention is not limited to these, but may be embodied in other ways within the subject-matter defined in the following claims.

The invention claimed is:

1. An antenna unit for wireless communication to a multitude of wireless interfaces, the antenna unit comprising a multitude of individual antennas, each antenna comprising a coil comprising at least one winding and the individual antennas embrace the same volume in that the windings of the individual antennas are wound around the same common volume so that the windings of two arbitrary antennas cross each other when viewed in an appropriate cross-sectional plane, wherein at least one of the antenna coils is adapted for providing an inductive coupling to another device, wherein at least one other of the antenna coils is adapted for communication with another device based on electromagnetic radiation, and wherein the inductance of the antenna coil adapted for providing an inductive coupling to another device has a first inductance and the antenna coil adapted for communication with another device based on electromagnetic radiation has a second inductance, wherein the first inductance is greater than the second inductance.

2. An antenna unit according to claim 1 comprising 2 individual antennas.

3. An antenna unit according to claim 1 comprising 3 individual antennas.

4. An antenna unit according to claim 1 wherein the mutual coupling between two individual antennas is controlled by the mutual angle of the windings of the two antennas when viewed in an appropriate cross sectional plane.

5. An antenna unit according to claim 1 wherein the windings of two individual antennas are substantially perpendicular to each other.

6. An antenna unit according to claim 1 wherein the windings of the individual antennas are wound around a common former.

7. An antenna unit according to claim 6 wherein the common former comprises a ceramic material.

8. An antenna unit according to claim 1 wherein the at least one coil being adapted for providing an inductive coupling to another device is adapted to operate around 4 MHz.

9. An antenna unit according to claim 1 wherein the at least one coil being adapted for communication with another device based on electromagnetic radiation is adapted to operate around 200 MHz.

10. A mobile telephone comprising an antenna unit according to claim 1.

11. A hearing aid comprising an antenna unit according to claim 1.

12. A hearing aid according to claim 11 wherein the at least one coil being adapted for providing an inductive coupling to another device is adapted to receive signals from the other device.

13. A hearing aid according to claim 11 wherein at least one of the at least one coil being adapted for communication with another device based on electromagnetic radiation is adapted to receive signals from the other device.

14. Use of an antenna unit according to claim 1 in a mobile phone or a hearing aid.

15. A hearing aid comprising a multitude of wireless interfaces, the hearing aid being adapted to provide that at least one of the wireless interfaces is based on magnetic near field communication, and at least one of the wireless interfaces is based on radiated field communication, the hearing aid comprising an antenna unit comprising a multitude of individual antennas, each antenna comprising a coil comprising at least one winding and the individual antennas being wound around the same common volume so that the windings of two arbitrary antennas cross each other at an angle when viewed in an appropriate cross-sectional plane, wherein at least one of the antenna coils is coupled to the wireless interface based on magnetic near field communication, and at least one of the other coils is coupled to the wireless interface based on radiated field communication, wherein the antenna coil adapted for magnetic near field communication has a first inductance and the antenna coil adapted for radiated field communication has a second inductance, wherein the first inductance is greater than the second inductance.

16. A hearing aid according to claim 15 wherein the number of coils is two or three and the angle between the two coils being coupled to the wireless interface based on magnetic near field communication and the wireless interface based on radiated field communication, respectively, is ninety degrees.

17. A hearing aid system comprising two hearing aids each according to claim 15, each hearing aid being adapted to communicate with the other hearing aid using the wireless interface based on magnetic near field communication or the wireless interface based on radiated field communication.

18. A hearing aid system according to claim 17, wherein one of the interfaces is used for wireless communication with another device.

19. A hearing aid system according to claim 18, wherein the wireless interface based on magnetic near field communication is used for wireless communication between the two hearing aids and the wireless interface based on radiated field communication one is used for wireless communication with another device.

20. A hearing aid system according to claim 18, wherein the other device is a mobile telephone.

21. A hearing aid system according to claim 18, wherein the other device is an audio signal selection device.

22. An antenna unit according to claim 1, the antenna unit comprising first and second antenna coils, one optimized for inductive coupling arranged with a main axis in an X direction, the other optimized for RF transmission based on electromagnetic radiation is arranged with a main axis in a Y direction, the first and second antenna coils having virtually no mutual coupling.

23. An antenna unit according to claim 22, wherein a direction of maximum inductive coupling is in the X direction, wherein the X direction coincides with the direction of maximum RF transmission, and wherein the direction of minimum RF transmission is in the Y direction, wherein the Y direction coincides with a direction of 6 dB reduced inductive coupling, and wherein in a Z direction the RF transmission is at a maximum and the inductive coupling is reduced 6 dB.

24. An antenna unit according to claim 1 wherein the inductive coupling is at a frequency below 100 MHz.

25. An antenna unit according to claim 1 wherein the inductive coupling is at a frequency below 30 MHz.

26. An antenna unit according to claim 1 wherein the electromagnetic radiation is in the RF-band.

27. An antenna unit according to claim 1 wherein the electromagnetic radiation is in the VHF-band.

28. A hearing aid according to claim 15 wherein the magnetic near field communication is at a frequency below 100 MHz.

29. A hearing aid according to claim 15 wherein the magnetic near field communication is at a frequency below 30 MHz.

30. A hearing aid according to claim 15 wherein the electromagnetic radiation is in the RF-band.

31. A hearing aid according to claim 15 wherein the electromagnetic radiation is in the VHF-band.

32. An antenna unit for wireless communication to a multitude of wireless interfaces, the antenna unit comprising a multitude of individual antennas, each antenna comprising a coil comprising at least one winding and the individual antennas embrace the same volume in that the windings of the individual antennas are wound around the same common volume so that the windings of two arbitrary antennas cross each other when viewed in an appropriate cross-sectional plane, wherein at least one of the antenna coils is adapted for providing an inductive coupling to another device at a frequency below 100 MHz, wherein at least one other of the antenna coils is adapted for communication with another device based on radiation in the RF-band, and wherein the inductance of the antenna coil adapted for providing an inductive coupling to another device has a first inductance and the antenna coil adapted for communication with another device based on radiation has a second inductance, wherein the first inductance is greater than the second inductance.

33. A hearing aid comprising a multitude of wireless interfaces, the hearing aid being adapted to provide that at least one of the wireless interfaces is based on magnetic near field communication, and at least one of the wireless interfaces is based on radiated field communication, the hearing aid comprising an antenna unit comprising a multitude of individual antennas, each antenna comprising a coil comprising at least one winding and the individual antennas being wound around the same common volume so that the windings of two arbitrary antennas cross each other at an angle when viewed in an appropriate cross-sectional plane, wherein at least one of the antenna coils is coupled to the wireless interface based on a first communication at a frequency below 100 MHz, and at least one of the other coils is coupled to the wireless interface based on a second communication in the RF-band, wherein the antenna coil adapted for the first communication has a first inductance and the antenna coil adapted for the second communication has a second inductance, wherein the first inductance is greater than the second inductance.

* * * * *